United States Patent [19]

Wilms et al.

[11] Patent Number: 4,861,510

[45] Date of Patent: Aug. 29, 1989

[54] PORPOUS LAYER SILICATE/SODIUM SULFATE AGGLOMERATE

[75] Inventors: Elman Wilms, Dormagen; Dieter Jung, Hilden; Herbert Linsenbold; Lothar Pioch, both of Duesseldorf; Winfried Wichelhaus, Mettmann, all of Fed. Rep. of Germany

[73] Assignee: Henkel Kommanditgesellschaft auf Aktien, Duesseldorf, Fed. Rep. of Germany

[21] Appl. No.: 146,450

[22] Filed: Jan. 21, 1988

[30] Foreign Application Priority Data

Jan. 24, 1987 [DE] Fed. Rep. of Germany ..... 37021117

[51] Int. Cl.[4] ..... C11D 3/12; C11D 7/20; C11D 11/02; C11D 17/06

[52] U.S. Cl. ..... 252/174.13; 252/89.1; 252/91; 252/174.21; 252/174.25; 423/328; 428/403; 502/407

[58] Field of Search ..... 23/313 R, 313 AS; 423/328, 330; 252/140, 174.13, 174.25, 90, 91, 174.21; 428/403

[56] References Cited

U.S. PATENT DOCUMENTS

| | | | |
|---|---|---|---|
| 3,966,629 | 6/1976 | Dumbrell | 252/140 |
| 4,062,647 | 12/1987 | Storm et al. | 8/137 |
| 4,096,081 | 6/1978 | Phenicie et al. | 252/174.25 |
| 4,184,975 | 1/1980 | Krings et al. | 252/140 |
| 4,190,551 | 2/1980 | Murata et al. | 252/99 |
| 4,288,342 | 9/1981 | Wagner et al. | 252/140 |
| 4,343,713 | 8/1982 | Wise | 252/92 |
| 4,414,129 | 11/1983 | Joshi | 252/135 |
| 4,462,804 | 7/1984 | Gangwisch et al. | 8/137 |
| 4,582,615 | 4/1986 | Ramachandran et al. | 252/8.6 |
| 4,609,473 | 9/1986 | Ramachandran et al. | 252/8.6 |
| 4,683,073 | 7/1987 | Diehl | 252/135 |
| 4,707,290 | 11/1987 | Seiter et al. | 252/140 |
| 4,713,193 | 12/1987 | Tai | 252/91 |
| 4,737,306 | 4/1988 | Wichelhaus et al. | 252/95 |

FOREIGN PATENT DOCUMENTS

| | | |
|---|---|---|
| 109717.8 | 5/1984 | European Pat. Off. . |

*Primary Examiner*—Prince E. Willis

*Attorney, Agent, or Firm*—Ernie G. Szoke; Wayne C. Jaeschke; Real J. Grandmaison

[57] ABSTRACT

An agglomerate containing sodium sulfate and as layer silicate, a synthetic layer silicate which has a smectite-like crystal phase, increased contents of bound alkali metal and silicate and a distinctly reduced swelling power compared with pure smectites. The agglomerate can take up significant quantities of an additional liquid component in its pores, resulting in a free-flowing agglomerate which outwardly feels dry. This high adsorption capacity may be used, for example, to take up a liquid detergent component which may then be mixed in combination with powder-form or granular detergent components to form a free-flowing detergent composition.

11 Claims, No Drawings

PORPOUS LAYER SILICATE/SODIUM SULFATE AGGLOMERATE

BACKGROUND OF THE INVENTION

1. Field of the Invention

This invention relates to a spray-dried layer silicate/-sodium sulfate agglomerate which is suitable as a constituent of solid, free-flowing detergent and cleaning preparations and which, by virtue of its porosity, is capable of taking up additional liquid constituents of detergent and cleaning preparations.

For a variety of reasons, certain constituents of solid, free-flowing detergent and cleaning preparations are unsuitable for spray-drying which is the most widely used process in detergent manufacture. Oxygen-releasing compounds tend to decompose prematurely at the high temperatures prevailing during spray drying. Other constituents, such as enzyme preparations for example, lose their activity under the spray drying conditions. Yet other constituents, for example nonionic surfactants, are removed from the detergent mixture with the evaporating water during spray drying and are thus lost to the dried detergent. The same applies to perfumes. Accordingly, those constituents which may be spray-dried without difficulty are generally spray-dried, while detergent constituents which cannot be spray-dried for the reasons explained above are optionally added to this primary product in another detergent manufacturing step. In many cases, however, the incorporation of liquid nonionic surfactants in relatively large quantities as a detergent constituent in a substantially dried, free-flowing product presents a problem. The uniformity of distribution of this liquid component to be added in relatively large quantities to the spray-dried primary product has to meet stringent requirements.

2. Discussion of Related Art

Earlier-filed European patent application 86/109717.8 describes layer silicates having a smectite-like crystal structure, but in comparative terms, a distinctly reduced swelling power in water. These layer silicates are synthetic, finely-divided, water-insoluble layer silicates which have a smectite-like crystal phase, but have increased contents of bound alkali metal and silicate and, compared with pure layer silicates of this type, a distinctly reduced swelling power in aqueous suspension and which have the following oxide summation formula $$MgO \cdot a\ M_2O \cdot b\ Al_2O_3 \cdot c\ SiO_2 \cdot n\ H_2O$$

wherein M represents sodium or a mixture of sodium and lithium, with the proviso that the molar ratio of sodium to lithium is at least 2, and wherein the parameters a, b, c and n each represent a number within the following ranges:

a is equal to 0.05 to 0.4,
b is equal to 0 to 0.3,
c is equal to 1.2 to 2.0, and
n is equal to 0.3 to 3.0.

In this oxide summation formula, the water content n $H_2O$ represents the water bound in the crystal phase. These very finely-divided clay minerals may be regarded as layer silicates having structural features of mica-like layer silicates, albeit with a dislocation in regard to the linkage of adjacent layers. A structural formula of the type usually expressed in idealized form for clay minerals can only be drawn up under additional hypotheses for the layer silicates according to the invention. However, the chemical composition of the new compounds shows more $Na_2O$ and $SiO_2$ than the associated saponite and hectorite smectite. It may be assumed that, in addition to the layer arrangement typical of mica-like compounds of this type, these layer silicates contain units of incorporated sodium silicates. From the viewpoint of structure and synthesis, the crystallization of the layer silicates may presumably be interpreted as a mixed crystal formation in which sodium silicate is incorporated in smectite. The X-ray diffractograms show that this incorporation is not regular, but instead leads to dislocations in the crystallites. Accordingly, crystallographic characterization by lattice constants which describe an elementary cell is not possible. On the basis of the chemical composition selected, synthetic smectites as defined above include saponite- and hectorite-like phases. The mixed crystal system should therefore be described by the following structural formula $$[Na_{x+y}(Mg_{3-x}Li_x)(Si_{4-y}Al_6)O_{10}(OH)_2] \cdot m\ [Na_2Si_zO_{2z+1}] \cdot n\ H_2O$$

the first part of the formula characterizing the smectite, and the second part the sodium polysilicate. both components form one phase in which the smectite determines the structure.

The variables may assume the following numerical values:

x is equal to 0 to 0.3, preferably 0 to 0.1;
y is equal to 0 to 0.5, preferably 0 to 0.4;
x+y is equal to 0.1 to 0.5, preferably 0.2 to 0.4;
z is equal to 1 to 22, preferable 1 to 14;
m is equal to 0.1 to 0.5, preferably 0.1 to 0.3; and
n is equal to 0 to 8, preferably 2 to 6.

The composition of the synthetic layer silicates according to the invention which differs distinctly from the pure smectites and the associated dislocation in the crystal structure leads to changes in a number of properties typical of layer silicates per se, particularly in regard to their swellability and hence their gel-forming properties and also in their exchange capacity.

These layer silicates have an incrustation-inhibiting effect in detergents having a standard composition. In contrast to layer silicates of the smectite type, these synthetic layer silicates have no fabric softening power or no pronounced softening power. By virtue of its incrustation-inhibiting effect, this synthetic layer silicate, the production of which is described in the earlier-filed European patent application cited above, is a valuable constituent of modern detergent and cleaning preparations, all the more so as both the softening smectite clays and also the alkali metal aluminosilicates of the zeolite A type described as hosphate substitutes are water-insoluble detergent constituents which can lead to fabric incrustation under certain conditions. Such fabric incrustation can be effectively suppressed by the synthetic layer silicates described in the earlier-filed European patent application. In their production by the process described in the earlier-filed European patent application cited above, the synthetic layer silicates accumulate in the form of an aqueous suspension of a mixture of layer silicate and sodium sulfate. Although the sodium sulfate can be separated from the layer silicate by washing out the layer silicate filtered off, it is best, because sodium sulfate itself is a detergent constituent present in most detergents, to further process the layer silicate/sodium sulfate mixture during the production of detergent and cleaning preparations. The further processing of the layer silicates containing sodium sulfate together with most of the other detergent constituents is already described in the earlier-filed European patent application cited above. Accordingly, the disclosure of that European patent application is also specifically made part of the disclosure of the present application.

The processing of the mixture of sodium sulfate and synthetic layer silicate to layer silicate/sodium sulfate agglomerates and, optionally, their further processing for free-flowing detergent and cleaning preparations has never been described hitherto. Accordingly, the problem solved by the present invention is to provide layer silicate/sodium sulfate agglomerates in which the layer silicate is the synthetic layer silicate mentioned above.

DESCRIPTION OF THE INVENTION

Other than in the operating examples, or where otherwise indicated, all numbers expressing quantities of ingredients or reaction conditions used herein are to be understood as modified in all instances by the term "about".

In accordance with this invention there is provided a porous layer silicate/sodium sulfate agglomerate wherein the layer silicate comprises a synthetic layer silicate having a smectite-like crystal phase, and an increased content of bound alkali metal and alkali metal silicate and a distinctly reduced swelling power in aqueous suspension compared with pure smectites, and which has the following oxide summation formula $$MgO \cdot a\ M_2O \cdot b\ Al_2O_3 \cdot c\ SiO_2 \cdot n\ H_2O \qquad (I)$$

wherein M represents sodium, or a mixture of sodium with lithium, with the proviso that the molar ratio of Na to Li is at least 2, and wherein a is equal to 0.05 to 0.4, b is equal to 0 to 0.3, c is equal to 1.2 to 2.0 and n is equal to 0.3 to 3.0, n representing the water bound in the crystal phase.

Although the ratio of synthetic layer silicate to sodium sulfate in the agglomerate according to the invention is not critical, agglomerates having particularly valuable properties are obtained when the ratio by weight of layer silicate to sodium sulfate is from 3:1 to 1:3. In one particularly preferred embodiment, the agglomerate according to the invention contains from 0.5 to 15% by weight water, based on the total weight of the agglomerate, in addition to the water bound in the crystal phase which, as indicated above, is present in a quantity of 0.3 to 3 moles in the layer silicate of oxide summation formula I.

An agglomerate of a layer silicate and sodium sulfate is known from U.S. Pat. No. 4,582,615 and 4,609,473. However, the layer silicate therein, unlike the layer silicate according to the present invention, is a naturally occurring, fabric-softening bentonite of the type known as a softening detergent constituent, for example, from U.S. Pat. No. 3,966,629 and 4,062,647. The agglomerate of the fabric-softening layer silicate and sodium sulfate is also described as a detergent component. However, it has been found that the agglomerate according to the present invention surprisingly has a much higher uptake capacity for liquids than the agglomerate according to U.S. Pat. Nos. 4,582,615 and 4,609,473. Accordingly, another preferred embodiment of the present invention is an agglomerate which contains an additional liquid component adsorbed in its pores in such quantity that the agglomerate is a free-flowing product which outwardly feels dry. The additional liquid component is preferably not additional water, but instead a constituent of a detergent or cleaning preparation which is liquid at room temperature or which is dissolved or dispersed in a liquid or which is liquefied by heating, more especially a nonionic surfactant. The agglomerate according to this invention takes up, for example, 35% by weight or more of liquid nonionic surfactant, retaining the character of an outwardly dry feeling, free-flowing agglomerate. By comparison, an agglomerate of sodium sulfate and naturally occurring layer silicate of the smectite type which has taken up 10% by weight of nonionic surfactant is no longer free-flowing and feels moist. Accordingly, an agglomerate containing an additional liquid component is another preferred embodiment of the present invention, particularly where the agglomerate contains from 2 to 50% by weight, based on the mixture of layer silicate and sodium sulfate, of an additional absorbed liquid component.

The agglomerate according to this invention may be produced by any known method for the production of agglomerates, for example by granulation, by tabletting, by compacting and, in particular, by spray-drying. To produce the agglomerate, a homogenized suspension of the type obtained in accordance with earlier-filed European patent application 86/109770.8 is sprayed in a spray tower and at the same time dried to a water content of from 0.5 to 15% by weight, resulting in a product according to the invention which may be used as a detergent constituent either as such or after adsorption of one or more liquid component of a detergent composition. Accordingly, the present invention relates to the use of such an agglomerate as a constituent of a solid, free-flowing detergent or cleaning composition, and to a detergent composition containing up to 50% by weight such layer silicate/sodium sulfate agglomerate. In addition to its use as an extremely absorbent carrier material for a liquid constituent of a detergent or cleaning preparation, the agglomerte according to this invention may also be used, for example, as a carrier for a fabric softener, as a carrier for a fertilizer or pesticide, optionally with an additional soil-improving agent, or as an abrasive.

In addition to the afore-mentioned agglomerates of this invention, the detergent composition according to this invention contains conventional surfactants, builders, and other conventional detergent constituents.

Typical surfactants that may be employed in this invention contain at least one hydrophobic organic radical and a watersolubilizing anionic, zwitter-ionic or nonionic group in the molecule. The hydrophobic radical is generally an aliphatic hydrocarbon radical containing from 8 to 26, preferably from 10 to 22, and more preferably from 12 to 18 carbon atoms, or an alkyl aromatic radical containing from 6 to 18 and preferably from 8 to 16 aliphatic carbon atoms.

Suitable anionic surfactants include, for example, soaps of natural or synthetic, preferably saturated, fatty acids or even of resinic or naphthenic acids. Suitable synthetic anionic surfactants include those of the sulfonate, sulfate and synthetic carboxylate type.

Suitable surfactants of the sulfonate type include alkyl benzenesulfonates (Cg to $C_{15}$ alkyl), olefin sulfonates, i.e. mixtures of alkene and hydroxyalkane sulfonates and also disulfonates of the type obtained, for example, from $C_{12}$–$C_{18}$ monoolefins containing a terminal or internal double bond by sulfonation with gaseous sulfur trioxide and subsequent alkaline or acidic hydrolysis of the sulfonation products. Also suitable are the alkane sulfonates obtainable from $C_{12}$–$C_{18}$ alkanes by sulfochlorination or sulfoxidation and subsequent hydrolysis or neutralization or by bisulfite addition to olefins and esters of α-sulfo-fatty acids, for example, α-sulfonated methyl or ethyl esters of hydrogenated coconut oil, palm kernel oil and tallow fatty acids.

Suitable surfactants of the sulfate type include the sulfuric acid monoesters of primary alcohols of natural and synthetic origin, i.e. of fatty alcohols such as, for example, coconut oil fatty alcohols, tallow fatty alcohols, oleyl alcohol, lauryl, myristyl, palmityl or stearyl alcohol, or the $C_{10}$–$C_{20}$ oxoalcohols and secondary alcohols of the same chain length. Sulfuric acid monoesters of aliphatic primary alcohols ethoxylated with from 1 to 6 moles of ethylene oxide, ethoxylated secondary alcohols and alkylphenols are also suitable. Sulfated fatty acid alcohol amides and sulfated fatty acid monoglycerides are also suitable.

Other suitable anionic surfactants include the fatty acid esters and amides of hydroxycarboxylic or aminocarboxylic acids and sulfonic acids, such as for example fatty acid sarcosides, glycolates, lactates, taurides and isethionates.

The anionic surfactants may be present in the form of their sodium, potassium and ammonium salts and also as soluble salts of organic bases, such an mono-, di- or tri-ethanolamine.

Suitable nonionic surfactants include adducts of from 1 to 40 and preferably from 2 to 20 moles of ethylene oxide with 1 mole of a compound containing 10 to 20 carbon atoms selected from the group consisting of alcohols, alkylphenols, fatty acids, fatty amines, fatty acid amides or alkane sulfonamides. Of particular importance are the adducts of from 8 to 80 moles of ethylene oxide with a primary alcohol, such as for example coconut oil or tallow fatty alcohol, with oleyl alcohol, with an oxoalcohol or with a secondary alcohol containing from 8 to 18 and preferably from 12 to 18 carbon atoms and with a mono- or dialkylphenol containing from 6 to 14 carbon atoms in the alkyl radical. In addition to these water-soluble nonionics, however, water-insoluble or substantially water-insoluble polyglycol ethers containing from 2 to 7 ethylene glycol ether groups in the molecule are also of interest, particularly if they are used together with water-soluble nonionic or anionic surfactants.

Other suitable nonionic surfactants include the water-soluble adducts, containing from 120 to 250 ethylene glycol ether groups and from 10 to 100 propylene glycol ether groups, of ethylene oxide with polypropylene glycol, alkylenediamine polypropylene glycol and with alkyl polypropylene glycol containing from 1 to 10 carbon atoms in the alkyl chain, in which the polypropylene glycol chain functions as the hydrophobic component. It is also possible to use nonionic surfactants of the amine oxide or sulfoxide type, for example, the compounds N-cocasalkyl-N, N-dimethylamine oxide, N-hexadecyl-N,N-bis-(2,3-dihydroxyproppyl)-amine oxide, and N-tallow alkyl-N,N-dihydroxyethylamine oxide.

The zwitter-ionic surfactants are preferably derivatives of aliphatic quaternary ammonium compounds, in which one of the aliphatic radicals consists of a $C_8$-$C_{18}$ radical, while another contains an anionic, water solubilizing carboxy, sulfo or sulfato group. Typical representatives of surface-active betaines such as these include, for example, the compounds 3-(N-hexadecyl-N,N-dimethylammonio)-propane sulfonate; 3-(N-tallow alkyl-N,N-dimethyl ammonio)-2-hydroxypropane sulfonate; 3-(N-hexadecyl-N,N-bis-(2-hydroxyethyl)-ammonio)-2-hydroxypropyl sulfate; 3-(N-cocasalkyl-N,N-bis-(2,3-dihydroxypropyl-ammonio)- propane sulfonate; N-tet-radecyl-N,N-dimethylammonioacetate; and N- hexadecyl-N,N-bis-(2,3-dihydroxypropyl)-ammonioacetate.

The foaming power of the surfactants may be increased or reduced by combining suitable surfactant types; a foaming reduction may also be obtained by the addition of non-surfactant-like organic compounds. Reduced foaming power, which is desirable where the detergent or cleaning preparations are used in machines, may often be obtained by combining surfactants of various types, for example sulfates and/or sulfonates with nonionic surfactants and/or soaps. In the case of soaps, foam inhibition increases with the degree of saturation and the number of carbon atoms in the fatty acid component. Accordingly, soaps of saturated $C_{20}$–$C_{24}$ fatty acids are particularly suitable as foam inhibitors.

The non-surfactant-like foam inhibitors are generally water-insoluble compounds mostly containing aliphatic $C_8$–$C_{22}$ hydrocarbon radicals. Suitable non-surfactant-like foam inhibitors include, for example, N-alkylaminotriazines, i.e., reaction products of 1 mole cyanuric chloride with 2 to 3 moles of a mono- or dialkylamine essentially containing from 8 to 18 carbon atoms in the alkyl radical. Other suitable non-surfactant-like foam inhibitors include propoxylated and/or butoxylated aminotriazines, for example, the reaction products of 1 mole of melamine with from 5 to 10 moles of propylene oxide and, in addition, from 10 to 50 moles of butylene oxide, and also aliphatic $C_{18}$–$C_{40}$ ketones such as, for example, stearone, fatty ketones of hardened train oil fatty acid or tallow fatty acid, paraffins and halogen paraffins melting below 100° C. and silicone oil emulsions based on polymeric organosilicon compounds.

Suitable builders include, typically, organic and inorganic salts, particularly alkali metal salts, showing a mildly acidic, neutral or alkaline reaction which are capable of precipitating or complexing calcium ions. Of the inorganic salts, the water-soluble alkali metal metaphosphates or alkali metal polyphosphates, particularly pentasodium triphosphate, are of particular importance along with alkali metal orthophosphates and alkali metal pyrophosphates. These phosphates may be completely or partly replaced by organic complexing agents for calcium ions, including compounds of the aminopolycarboxylic acid type, such as for example, nitrilotriacetic acid (NTA), ethylenediamine tetra-acetic acid (EDTA), diethylenetriamine penta-acetic acid and higher homologs. Suitable phosphorus-containing organic complexing agents include the water-soluble salts of alkane polyphosphonic acids, amino- and hydroxyalkane poly-phosphonic acids and phosphonopolycarboxylic acids such as, for example, methane diphosphonic acid, dimethylaminomethane-1,1-diphosphonic acid, aminotrimethylene triphosphonic acid, 1-hydroxyethane-1,1-diphosphonc acid, 1-phosphonoethane-1,2-dicarboxylic acid, and 2-phosphonobutane-1,2,4-tricarboxylic acid.

Among the organic builders, nitrogen- and phosphorus-free polycarboxylic acids which form complex salts with calcium ions, including polymers containing carboxyl groups, are of particular significance. Suitable organic builders of this type include, for example, citric acid, tartaric acid, benezenehexacarboxylic acid and tetrahydrofuran tetracarboxylic acid. Also suitable are polycarboxylic acids containing ether groups, such as 2,2'-oxydisuccinic acid and poly-functional alcohols or hydroxycarboxylic acids completely or partly etherified with glycolic acid, for example biscarboxymethyl ethylene glycol, carboxymethyloxysuccinic acid, carboxymethyl tartronic acid and carboxymethylated or oxidized polysaccharides. Polymeric carboxylic acids having a molecular weight of from 350 to 1,500,000 in the form of water-soluble salts are also suitble. Particularly preferred polymeric polycarboxylates have a molecular weight of from 500 to 175,00 and more especially in the range from 10,000 to 100,000. These compounds include, for example, polyacrylic acid, poly-α-hydroxyacrylic acid, polymaleic acid and also copolymers of the corresponding monomeric carboxylic acids with one another or with ethylenically unsaturated compounds, such as vinylmethyl ether. Water-soluble salts of polyglyocylic acid are also suitable. Suitable water-insoluble inorganic builders include the finely-divided, synthetic sodium aluminosilicates of the zeolite A type containing bound water which are described in German patent application 24 12 837 as phosphate substitutes for detergent and cleaning preparations.

The cation-exchanging sodium aluminosilicates are used in their usual hydrated, finely crystalline form, i.e. they contain virtually no particles larger than 30 microns, and preferably consist of at least 80% of particles smaller than 10 microns in size. Their calcium binding power as determined in accordance with German patent application 24 12 837 is in the range from 100 to 200 CaO/g. Zeolite NaA is particularly suitable as are zeolite NaX and mixtures of NaA and NaX.

Suitable inorganic, non-complexing salts include the alkali metal salts, also known as "washing alkalis", of bicarbonates, carbonates, borates, sulfates and silicates. Of the alkali metal silicates, sodium silicates in which the weight ratio of $Na_2O$ to $SiO_2$ is from 1:1 to 1:3.5 are particularly preferred.

Other builders which are generally used in liquid preparations by virtue of their hydrotropic properties include the salts of non-capillary-active $C_2$–$C_9$ sulfonic acids, carboxylic acids and sulfocarboxylic acids, for example, the alkali metal salts of alkane, benzene, toluene, xylene or cumene sulfonic acids, sulfobenzoic acid and the salts of acetic acid or lactic acid. Acetamide and urea are also suitable solubilizers.

The detergent and cleaning preparations according to this invention may contain as a further component a soil suspending agent which suspends the soil detached from the fabrics in the solution and thus prevents its redeposition. Suitable soil suspending agents include water-soluble, generally organic colloids, such as for example, water-soluble salts of polymeric carboxylic acids, glue, gelatin, salts of ether caboxylic acids or ether sulfonic acids of starch or cellulose, or salts of acidic sulfuric acid esters of cellulose or starch. Water-soluble polyamides containing acidic groups are also suitable for this purpose. It is also possible to use soluble starch preparations and other starch products than those mentioned above, such as for example degraded starch, aldehyde starches, etc. Polyvinylpyrrolidone may also be used. In many cases, an addition of polyvinylpyrrolidone suppresses the undesired transfer of dyes which have been detached from intensively dyed fabrics, to less intensively dyed or undyed fabrics.

Among the compounds releasing $H_2O_2$ in water which are used as bleaches, sodium perborate tetrahydrate ($NaBO_2 \cdot H_2O_2 \cdot 3\ H_2O$) and the monohydrate ($NaBO_2 \cdot H_2O_2$) are of particular importance. However, other borates which yield $H_2O_2$, for example perborax ($Na_2B_4O_7 \cdot 4\ H_2O_2$) are also suitable. These compounds may be completely or partly replaced by other active oxygen carriers, more especially by peroxypyrophosphates, citrate perhydrates, urea/$H_2O$Hd 2 or melamine/$H_2O_2$ compounds and by $H_2O_2$-yielding peracidic salts, such as for example caroates ($KHSO_5$), perbenzoates or peroxyphthalates.

Since the detergent composition according to this invention is inter alia intended for washing at low washing temperatures, bleach components containing activators are preferably incorporated therein. Certain N-acyl and O-acyl compounds which form organic per-acids serve as activators for per compounds releasing $H_2O_2$ in water. Suitable compounds include, inter alia, N-diacylated and N,N'-tetra-acylated amines such as, for example, N,N,N',N'-tetra-acetyl methylenediamine and ethylenediamine or tetra-acetyl glycoluril.

The detergent composition may additionally contain an optical brightener, for example for cotton or polyamide fibers.

EXAMPLE I 616 g magnesium sulfate heptahydrate were dissolved in 2 liters deionized water and the resulting solution reacted while vigorously stirred with 755 g of a solium gilicate solution containing 27 g $SiO_2$ and 8 g $Na_2O$ per 100 g. A finely divided suspension was formed. A solution of 404 g of 50% sodium hydroxide, 1.5 liters deionized water and 20.2 g hydrargillite containing 63% $Al_2O_3$ was added to this suspension with continued stirring.

The suspension was then heated for 20 minutes to 190° C. in a stirring autoclave and stirred at that temperature for 4 hours. After cooling to 100° C., the stirring autoclave was emptied and the layer silicate formed was filtered off from the mother liquor. The filter cake was washed with deionized water on the filter until no more sulfate could be detected in the washing water. The filter cake was then dried at about 100° C. in a recirculating air drying cabinet.

Analysis of the product, in accordance with this invention, gave the following composition (in % by weight): MgO: 22.8%, $Na_2O$: 5.7%, $Al_2O_3$: 3.2%, $SiO_2$: 46.8%, $H_2O$: 21.2%.

The X-ray diffractogram of the layer silicate shows broad reflexes with maxima at d (Å): 13.4; 4.5; 2.57 and 1.535.

A bright white, granular product having a residual water content of 8.6% by weight, which contained a main sieve fraction of 67% by weight on a 0.2 mm sieve, was prepared from a layer silicate suspension containing 10.65 by weight of the above-described layer silicate, 13.2% by weight Na sulfate, remainder water, by spray drying in a spray tower. The weight per liter was 506 g. After this granular product had been sprayed with 35% by weight of a nonionic surfactant consisting of a mixture of 80 parts $C_{12}$–$C_{18}$ fatty alcohol +5 moles of ethylene oxide and 20 parts $C_{12}$–$C_{14}$ fatty alcohol +3 moles of ethylene oxide, a product was obtained which outwardly felt dry and which showed good flow properties.

EXAMPLE II

A different layer silicate batch from that of Example I, containing 13.3% by weight layer silicate of the type described above, 14.2% by weight sodium sulfate, remainder water, was sprayed in the same way as described in Example I. A bright white, granular product having a residual water content of 7.0% by weight and a main sieve fraction of 81% by weight on a 0.2 mm sieve was obtained. The weight per liter was 421 g. After this product had been sprayed with 35% by weight of the nonionic surfactant as in Example I, again based on the weight of the sprayed product, a free-flowing product which outwardly felt dry was again obtained.

The spray-dried products of Example I and II showed high compressive strength on the one hand, but on the other hand readily disintegrated in water to form a finely-divided suspension.

COMPARISON EXAMPLE

A dark white, granular spray-dried product was produced as described above from a bentonite suspension containing 13.3% by weight bentonite ("DIS THIX EXTRA":, a product of Schwegmann), 15.2% by weight sodium sulfate, remainder water. For a weight per liter of 420 g, this product had a main sieve fraction of 93% by weight on a 0.2 mm sieve. The residual water content was 9.9% by weight. Whereas this spray-dried product flowed freely, a product sprayed with only 10% by weight of the noninic surfactant of Example I, again based on the weight of the spray-dried product, caked together to form a coarse mass consisting of moist particles which was no longer free-flowing.

We claim:

1. A spray-dried, porous granular porduct consisting essentially of layer silicate/sodium sulfate wherein said layer silicate consists of a synthetic layer silicate having a smectite-like crystal phase, and an increased content of bound alkali metal and alkali metal silicate and a distinctly reduced swelling power in aqueous suspension compared with a pure smectite, and which has the following oxide summation formula $$MgO \cdot a\ M_2O \cdot b\ Al_2O_3 \cdot c\ SiO_2 \cdot n\ H_2O \qquad (I)$$

wherein M represents sodium or a mixture of sodium with lithium, with the proviso that the molar ratio of Na to Li is at least 2, and wherein a is equal to about 0.05 to about 0.4, b is equal to about 0 to about 0.3, c is equal to about 1.2 to about 2.0 and n is equal to about 0.3 to about 3.0, n representing the water bound in the crystal phase, said layer silicate and said sodium sulfate being present in a weight ratio of from about 3:1 to about 1:3, said spray-dried granular product containing from about 0.5% to about 15% by weight of water in addition to the water bound in the crystal phase of said layer silicate, based on the weight of the granular product, and said granular product having a liquid adsorbing capacity of from about 2% to about 50% by weight of a liquid, based on the weight of the granular product.

2. A granular product as in claim 1 containing a liquid component adsorbed in its pores in such a quantity to provide a free-flowing product which outwardly feels dry.

3. A granular product as in claim 2 wherein said liquid component is a component of a detergent composition.

4. A granular product as in claim 2 wherein said liquid component comprises a nonionic surfactant.

5. A granular product as in claim 2 wherein said liquid component is present in an amount of up to about 35% by weight, based on the weight of said granular product.

6. A detergent composition comprising a surfactant, builder, and a spray-dried, porous granular product consisting essentially of layer silicate/sodium sulfate wherein said layer silicate consists of a synthetic layer silicate having a smectite-like crystal phase, and an increased content of bound alkali metal and alkali metal silicate and a distinctly reduced swelling power in aqueous suspension compared with a pure smectite, and which has the following oxide summation formula $$MgO \cdot a\ M_2O \cdot b\ Al_2O_3 \cdot c\ SiO_2 \cdot n\ H_2O \qquad (I)$$

wherein M represents sodium, or a mixture of sodium with lithium, with the proviso that the molar ratio of Na to Li is at least 2, and wherein a is equal to about 0.05 to about 0.4, b is equal to 0 to about 0.3, c is equal to about 1.2 to about 2.0 and n is equal to about 0.3 to about 3.0, n representing the water bound in the crystal phase, said layer silicate and sodium sulfate being present in a weight ratio of from about 3:1 to about 1:3, said spray-dried granular product containing from about 0.5% to about 15% by weight of water in addition to the water bound in the crystal phase of said layer silicate, based on the weight of the granular product, and said granular product having a liquid adsorbing capacity of from about 2% to about 50% by weight of a liquid, based on the weight of the granular product.

7. A detergent composition as in claim 6 wherein said granular product contains a liquid component adsorbed in its pores in such a quantity to provide a free-flowing product which outwardly feels dry.

8. A detergent composition as in claim 7 wherein said liquid component comprises a noionic surfactant.

9. A detergent composition as in claim 7 wherein said liquid component is present in an amount of up to about 35% by weight, based on the weight of said granular product.

10. A detergent composition as in claim 6 wherein said surfactant is selected from the group consistent of an anionic, zwitter-ionic, and nonionic surfactant.

11. A detergent composition as in claim 6 wherein said builder is an organic or inorganic salt.

* * * * *

UNITED STATES PATENT AND TRADEMARK OFFICE

CERTIFICATE OF CORRECTION

PATENT NO. : 4,861,510

DATED : August 29, 1989

INVENTOR(S) : Elman Wilms et al.

It is certified that error appears in the above-identified patent and that said Letters Patent is hereby corrected as shown below:

On the title page, and column 1, line 2:
In the title, for "Porpous" read --Porous--.

In Claim 1, Col. 9, line 36, "porduct" should read --product--.

Signed and Sealed this

Twenty-second Day of January, 1991

*Attest:*

HARRY F. MANBECK, JR.

*Attesting Officer*

*Commissioner of Patents and Trademarks*